United States Patent [19]

Kosner

[11] 4,411,416

[45] Oct. 25, 1983

[54] VACUUM DOCUMENT FEEDER

[75] Inventor: Jerry J. Kosner, La Grange, Ill.

[73] Assignee: Bell & Howell Company, Chicago, Ill.

[21] Appl. No.: 322,111

[22] Filed: Nov. 16, 1981

[51] Int. Cl.[3] ..... B65H 3/08

[52] U.S. Cl. ..... 271/11; 271/20; 271/30 A; 271/91; 271/106; 271/107

[58] Field of Search ..... 271/20, 91, 92, 102, 271/106, 107, 30 A, 11

[56] References Cited

U.S. PATENT DOCUMENTS

| | | | |
|---|---|---|---|
| 2,145,764 | 1/1939 | Goebel | 271/91 |
| 2,950,913 | 8/1960 | Staines | 271/92 |
| 3,673,759 | 7/1972 | Ayres | 271/91 X |
| 3,690,477 | 9/1972 | Nilsson | 271/91 X |
| 4,013,283 | 3/1977 | Tress | 271/106 X |

FOREIGN PATENT DOCUMENTS

| | | | |
|---|---|---|---|
| 1252515 | 12/1960 | France | 271/91 |

*Primary Examiner*—Richard A. Schacher
*Attorney, Agent, or Firm*—Alan B. Samlan; Neal C. Johnson; Alan H. Haggard

[57] ABSTRACT

A new and improved vacuum document feeder provides a vacuum cup support mechanism which follows a somewhat crescent-shaped coupler curve that eliminates the vacuum cup wear-producing disadvantages of the prior art; improves separation of documents, and provides for increased feeding rates. A four-bar system moves a table over the somewhat crescent-shaped coupler curve, while at all times holding an edge of the table parallel to the documents. Two vacuum cups are individually pivotally mounted on the table, to sweep over an angle which accommodates leaning documents. Cams on a drive pulley associated with the transport system coordinates the table movement with both the pivoting and vacuumizing of the cups. The cups move in a manner to cause the document to buckle thereby improving separation between documents and eliminating double feeding.

10 Claims, 23 Drawing Figures

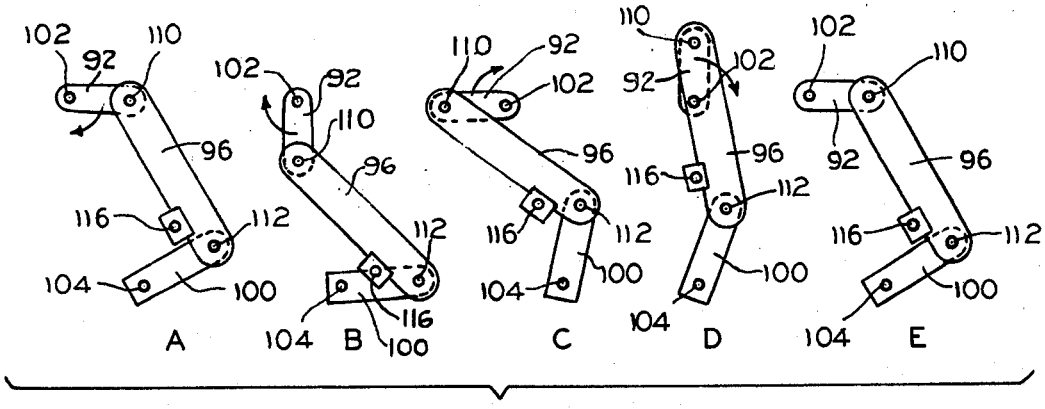
FIG.9
FIG.12
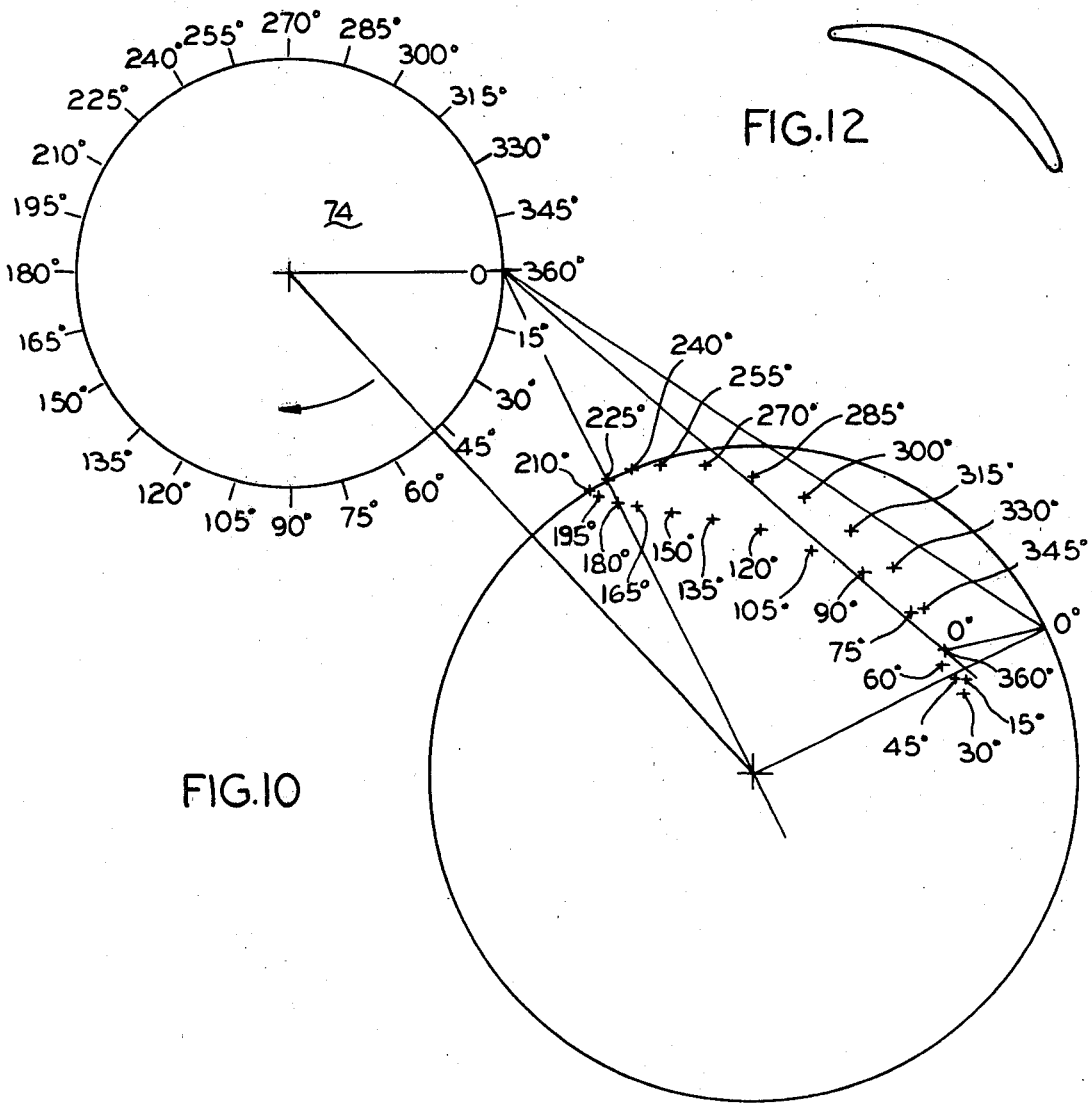
FIG.10

VACUUM DOCUMENT FEEDER

BACKGROUND AND SUMMARY OF THE INVENTION

This invention relates to document feeder and delivery systems and, more particularly, to vacuum systems which are adapted to tolerate a greater degree of document misalignment, document thickness variations, document size intermix, and surface non-uniformity, than was heretofore possible and to reduce the wear and tear on vacuum cups used to pick up the documents.

The inventive document feeder and delivery system uses vacuum cups designed to pick up one document at a time and to deliver it to a document transport and processing machine. A horizontal stack of vertically oriented envelopes is exemplary of the arrangements and types of documents which are likely to be handled by the inventive document feeder. A postage scale and metering machine is exemplary of a document-processing machine which is likely to be fed by the inventive document feeder system. However, the invention is not necessarily limited to feeding envelopes or to any other specific document form.

The envelopes are stacked on an edge, and the stack is placed horizontally on a belt. The belt moves the envelopes into the reach of the vacuum cups. The vacuum cups pivot on a circular arc toward the exposed end of the stack of envelopes. The pivot point of the vacuum cup arc is located below the envelope. On each cycle, the vacuum cups grasp one of the envelopes and then positions it within the grasp of a document transport system. The transport system carries the envelope away while the vacuum cups go back to get the next envelope.

In prior feeding systems, the vacuum cups would withdraw an envelope from the stack, remove the vacuum, and drop the envelope onto a second moving belt located below the stack. Furthermore, no provision was made for envelopes presented at a skewed angle or for an intermix of envelopes having varying thicknesses. This type of system had five common problems. The envelopes drop from the cups because they are accelerated by the force of gravity. The time required for the envelope to fall, limits the cycle speed of the machine. At higher speeds, the vacuum cups drop an envelope and return fast enough to impact the same envelope. This impact abrades the cups and shortens their life. The envelopes are not positively positioned into the document transport and, at times, hang up on the second moving belt and never reach the transport system. A vacuum cup depends, at least in part, upon its being seated squarely upon the envelope. Therefore, if the envelope is presented to the cups at a skewed angle, the vacuum may not be properly formed. This increases the expense and complexity of the envelope registration system. Finally, there was not any provision for manipulating the vacuum cups to aid in separation of adjacent documents.

Some of these problems were overcome by Applicant's assignee in copending application Ser. No. 148,068 filed May 12, 1980 entitled VACUUM DOCUMENT FEEDER now U.S. Pat. No. 4,346,876. This copending application was an improvement over prior designs but Applicant was able to improve further over this device. The device in the '068 disclosure did not always provide for singular pick off of the envelope from the stack. This was due to vacuum bleed through tending to hold together two relatively thin envelopes. Also, a static charge between envelopes tended to keep adjacent envelopes together. Furthermore, when one envelope is pulled away from a second envelope in a perpendicular plane from the first, air pressure tends to suck the second envelope along with the first.

Accordingly, an object of the invention is to provide new and improved vacuum envelope feeders. Here, an object is to provide a vacuum cup support mechanism which follows a path that eliminates the above-stated disadvantages. In this connection, an object is to provide a low-cost mechanism which accomplishes the foregoing and other objects, in new and improved ways.

An additional object is to provide a document feeder to reliably separate and feed an intermix of media varying in length, height, and thickness. It is also an object to provide vacuum cup path that traces a route such that the cup clears the fed document on its return stroke to pick off the next document. A further object is to provide a feeder which presents documents to the vacuum cups in a constant orientation and with minimum inter-document force.

A related object is to provide a document feeder which allows the pick off mechanism to remove only the first envelope from a stack of envelopes without also pulling a second adjacent envelope from the stack.

In keeping with an aspect of the invention, the foregoing and other objects are accomplished by a four-bar linkage or lever arm system which moves a table over a somewhat crescent-shaped coupler curve, while at all times holding an edge of that table parallel to the envelopes. At least two vacuum cups are pivotally mounted on the table to tilt at an angle which is large enough to accommodate poorly registered envelopes. The vacuum cups pivot in such a manner that they cause the lead envelope to buckle aiding in separation of the lead envelope from the stack. A cam on a drive wheel associated with the four-bar linkage coordinates the table movement with the vacuumizing of the cups. The pivoting of the cups is accomplished by a cam follower system driven by a universal drive system.

BRIEF DESCRIPTION OF THE DRAWINGS

A preferred embodiment of this invention is seen in the attached drawings wherein:

FIG. 9 shows five stop-motion positions of a pair of bars taken from the four-bar mechanism of FIG. 6;

FIG. 10 graphically illustrates the somewhat crescent-shaped coupler curve followed by the table of FIG. 8 as it is transported by the four-bar system of FIG. 6.

FIG. 12 illustrates an alternative crescent-shaped coupler curve as traced by the four-bar mechanism of FIG. 6, in which both ends are rounded.

DETAILED DESCRIPTION OF THE PREFERRED EMBODIMENT

Figure 1:
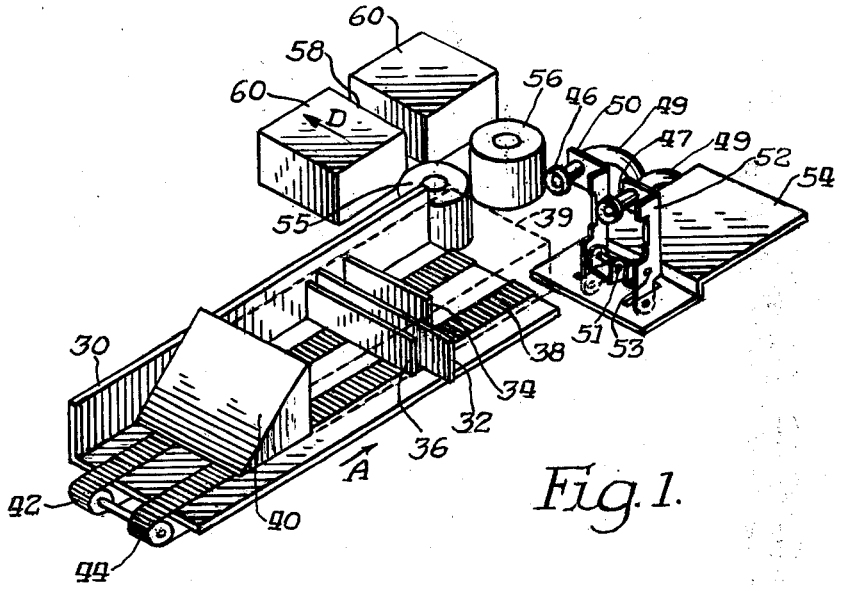
FIG. 1 is a perspective view of an exemplary machine which might use the invention.

The invention will find use anytime that it is desirable to separate documents, one at a time, from a horizontally-oriented stack of documents. Nevertheless, for convenience of description and to present a concrete example, the invention is shown in FIG. 1, in association with a machine for handling mailing envelopes.

In greater detail, documents in the form of envelopes, or the like, are vertically placed in a horizontal stack on a movable belt 42, 44 cycled on and off with a photodetector depending on feed speeds. The stack is aligned at one end against a vertical fence 30 (FIG. 1). These envelopes may be any size; therefore, FIG. 1 shows, by way of example, a large envelope 32, a small envelope 34 and a middle-sized envelope 36. The entire horizontal stack of envelopes is represented by a dashed line rectangular configuration 38 having a document 39 at the feed end of the stack. A suitable support or back stop 40 resting on the belts 42, 44 supports the envelopes in their vertical position. Any convenient number of conveyor belts 42, 44 moves the stack of envelopes in direction A. Each of these belts has vertically upstanding teeth to engage the bottom edges of every third or forth envelope; these teeth act to retain the stack, preventing the bottom edge of the documents from sliding forward, and maintaining stack integrity without any inter-document force (other than the component of force due to the weight of the document).

A pivotally supported pair of vacuum cups 46, 47 are positioned to cyclically swing over an arc and pick up the envelopes, one at a time. Vacuum cup 46 will hereinafter be referred to as lead cup 46 and vacuum cup 47 will hereinafter be referred to as follower cup 47 for reasons which will be made clear in the following detailed description. The vacuum is supplied to these cups via any suitable tubes 49. The lead cup 46 is mounted on the free end of pivoted bracket 50 to swing back and forth over an arc, in directions B-C, about an axis 51, which is fixedly mounted on a moving table 54. The follower cup 47 is mounted on the free end of pivoted bracket 52 to swing over the same arc B-C about an axis 53 which is also attached to moving table 54.

A pair of nip rollers 55, 56 are positioned near the vacuum cups at a location where the rollers form part of a document transport system which may carry away the envelopes after they are released from the vacuum cups. The nip rollers 55, 56 propel the envelope in the direction D and into a slot 58 of any suitable document-processing machine 60. The exact nature of the machine 60 is irrelevant to the invention. It might be thought of as a scale and postage meter combination which weighs the envelope and then applies the correct postage thereto.

Figure 2:
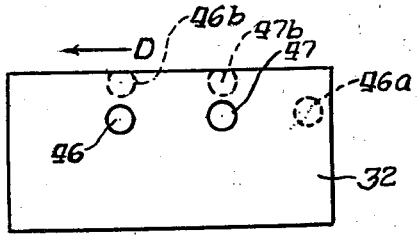
FIG. 2 schematically illustrates vacuum cup document feed problems which have been encountered in the past.
Figure 3:
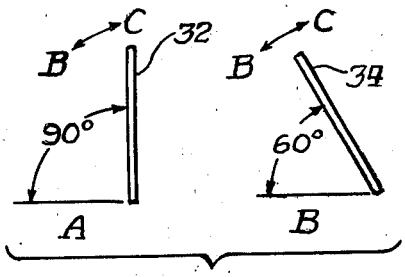
FIG. 3 schematically illustrates an alternate vacuum cup document feed problem which has been encountered in the past.

Some of the problems encountered heretofore in vacuum document feed machines such as this, are explained with the help of FIGS. 2, 3. In greater detail, FIG. 2 shows the envelope 32 as being lifted by the vacuum cups 46 shown by solid line circles for transportation into the transport nip of the rollers on 55, 56. As the envelope goes flying off the vacuum cups in direction D, it may still be in the path of the vacuum cups when they are moved in for the next document pickup. Thus, at least one of the vacuum cups 46*a* (shown by a dashed line circle) may impact and/or engage an end of the envelope 32 which was just released. This contact with the same envelope causes undesired effects. First, the nip rollers 55, 56 will snatch the envelope off the vacuum cup if the cup engaged the envelope at position 46*a* and abrade the cup, thereby shortening its life. Second, the vacuum cup might have a sufficient force on envelope 32 to change its alignment and thereby deflect or damage it or cause it to jam in the nip. Third, the vacuum cups can complete the cycle with a second envelope which could cause the two envelopes to attempt a simultaneous feed which causes an undesireable double feed or jams the entire system.

Another problem encountered in a prior document feed machine is further illustrated in FIG. 2. This problem relates to a prior feeding system whereby the envelopes are withdrawn from the stack and dropped onto a conveyor or into a hopper. As the envelope is dropped, it may still be in the path of the vacuum cups as they return to pick up the next document. Thus, both cups 46*b* and 47*b* (shown by the dashed line circle) may impact the top edge of the envelope which was just released. This results in the same undesired effects as listed above.

FIG. 3 shows that the documents do not always stand perfectly upright and vertically in the stack 38 (FIG. 1). For example, the envelope 32 has been drawn as standing perpendicularly with respect ot the belts 42, 44, while envelope 34 has been drawn as leaning at 60 degrees. If an envelope does not rest squarely upon the periphery of the vacuum cup, the vacuum might not form properly. Therefore, it sometimes has heretofore been difficult to pick up badly registered documents.

According to an aspect of the invention, these and other problems are solved by providing a table which is mounted on a mechanical transport system which follows a somewhat crescent-shaped coupler curve, while continuously holding a pair of vacuum cups in a plane which is parallel to the documents that are being fed into the device. The vacuum cups are mounted on the swinging ends of pivotal arms, which due to their mounting arrangement engage the lead document and pinch it causing it to buckle. This aids in separation of the document from the stack.

Figure 4:
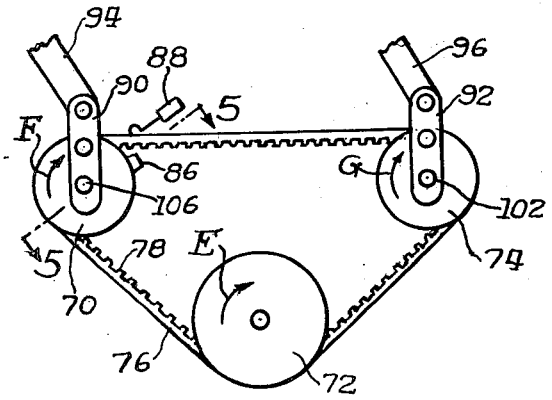
FIG. 4 is a plan view which shows the power drive system and associated input arms and initial parts of a four-bar linkage or lever arm system.
Figure 5:
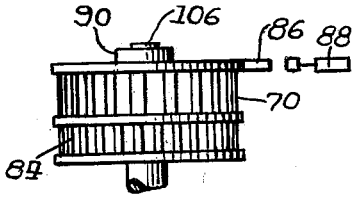
FIG. 5 is a vertical elevation of one timing pulley control cam taken along line 5—5 of FIG. 4.
Figure 6:
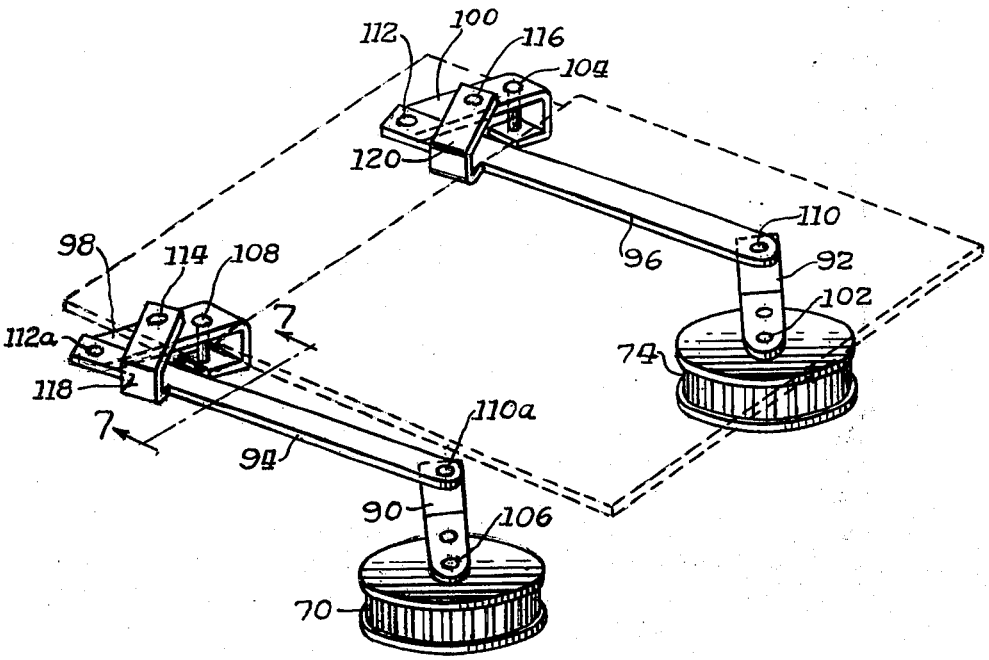
FIG. 6 is a perspective view of the four bar system and one timing pulley and one drive pulley.

One preferred embodiment of the invention is shown and explained in the remaining FIGS. 4–21. In greater datail, the power train for the vacuum document mechanism is shown in FIG. 4 and driven by a suitable drive system (FIG. 8) coupled to a drive belt system. In one embodiment, a drive pulley 70 was coupled to two driven timing pulleys 72, 74 by a belt 76 having teeth, as shown at 78, for example. The peripheries of the wheels 70–74 have suitable teeth for meshing with and being driven by the teeth 78 on the toothed belt 76. Accordingly, the drive system turns the drive pulley 70 and the two driven timing pulleys 72, 74 turn synchronously, in phase with each other.

The drive pulley 70 has a lower drive gear 84 keyed to itself or to axle 106 so that they rotate together when power is applied through gear 84. The drive pulley 70 also has a cam 86 which is cut with a profile that identifies a phase in the cyclic mechanical movements of table 54. In this embodiment, the cam 86 controls the application or removal of a vacuum to the vacuum cups 46, 47. Microswitch 88 is positioned at any suitable location to cause the controlled function to occur at desired times in a cycle defined by one complete rotation of the drive pulley 70. These functions are described in FIG. 11, where the angular notations on the horizontal axis refer to incremental stages in one complete 360° revolution of the drive pulley 70.

Rigidly attached to and rotating with the pulleys 70, 74 are two input bars or levers 90, 92 which are pivotally connected to a four-bar system, beginning with the coupler or arms 94, 96.

The details of the table 54, vacuum cup supporting pivot arms 50, 52 and the four-bar linkage system are seen in FIGS. 6–9. The specific linkage can be modified to produce a crescent shaped coupled curve which has two cusps, a coupler curve with one cusp and one rounded end, or a coupler curve with two rounded ends, which resembles a banana shape. The preferred embodiment was a coupler curve having one cusp and one rounded end.

In greater detail, the individual links or bars in the four-bar linkage are designated 94, 96, 98, 100. The ground points for the four-bar linkage 92, 96, 100 ground are the axle 102 of the pulley 74 and pivot point 104. Point 104 is formed by a vertical post fixed onto a chassis (not shown). The ground points for the other four-bar linkage 90, 94, 98 ground are the axle 106 of the pulley 72, and pivot point 108, also fixed onto the chassis. The opposite ends of bar 96 are pivotally connected to bars 92, 100 at points 110, 112. The opposite ends of bar 94 are pivotally connected in a similar manner at points **110*a*, 112*a***.

Each of the bars 94, 96 carries a bearing point 114, 116 on supports 118, 120 respectively, for supporting the tabel 54. This bearing point defines the crescent-shaped coupler curve. The two four-bar linkages 92, 96, 100, ground and 90, 94, 98, ground are identical and are timed such that a line through the bearing points 114, 116, always remains parallel to the end of the stack 38 (FIG. 1) of documents.

U-shaped brackets 122, 123 (FIG. 8) are screwed, or otherwise secured to or formed in the top of table 54. The vacuum cup supporting pair of pivot arms 50, 52 are pivotally connected to brackets 122, 123 by means of their respective shafts 51, 53.

The axis of shaft 53 is parallel to a line through the bearing points 114, 116 and is also parallel to the end of the stack 38 of documents. The axis of shaft 51 is placed at a small angle of approximately 8° relative to the axis of shaft 53. This causes pivot arm 50 to move towards and away from the stack 38 at an angle of approximately 82° rather than the 90° angle which pivot arm 53 moves with respect to the stack 38. The reasons for the angled positioning of shaft 51 will be more fully described later when FIGS. **19*a*–19*c*** are discussed.

Figure 7:
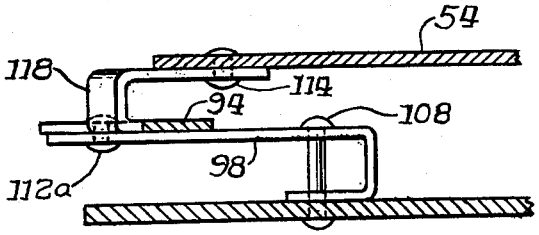
FIG. 7 is an elevation view partially in cross section taken along lines 7—7 of FIG. 6 showing the table support and table pivot points.

The arms 50, 52 are free to swing over an arc B-C and between two positions, a forwardmost postion, and an upright position as shown in FIG. 7 of U.S. Pat. No. 4,346,876 the entirety of which is herein incorporated by reference. Documents are picked up during the swing in direction B. Coiled tension spring 124 connected to the arm 52 below shaft 53 normally biases the arm 52 towards its forwardmost position. The function of spring 124 will more clearly be explained below.

Figure 8:
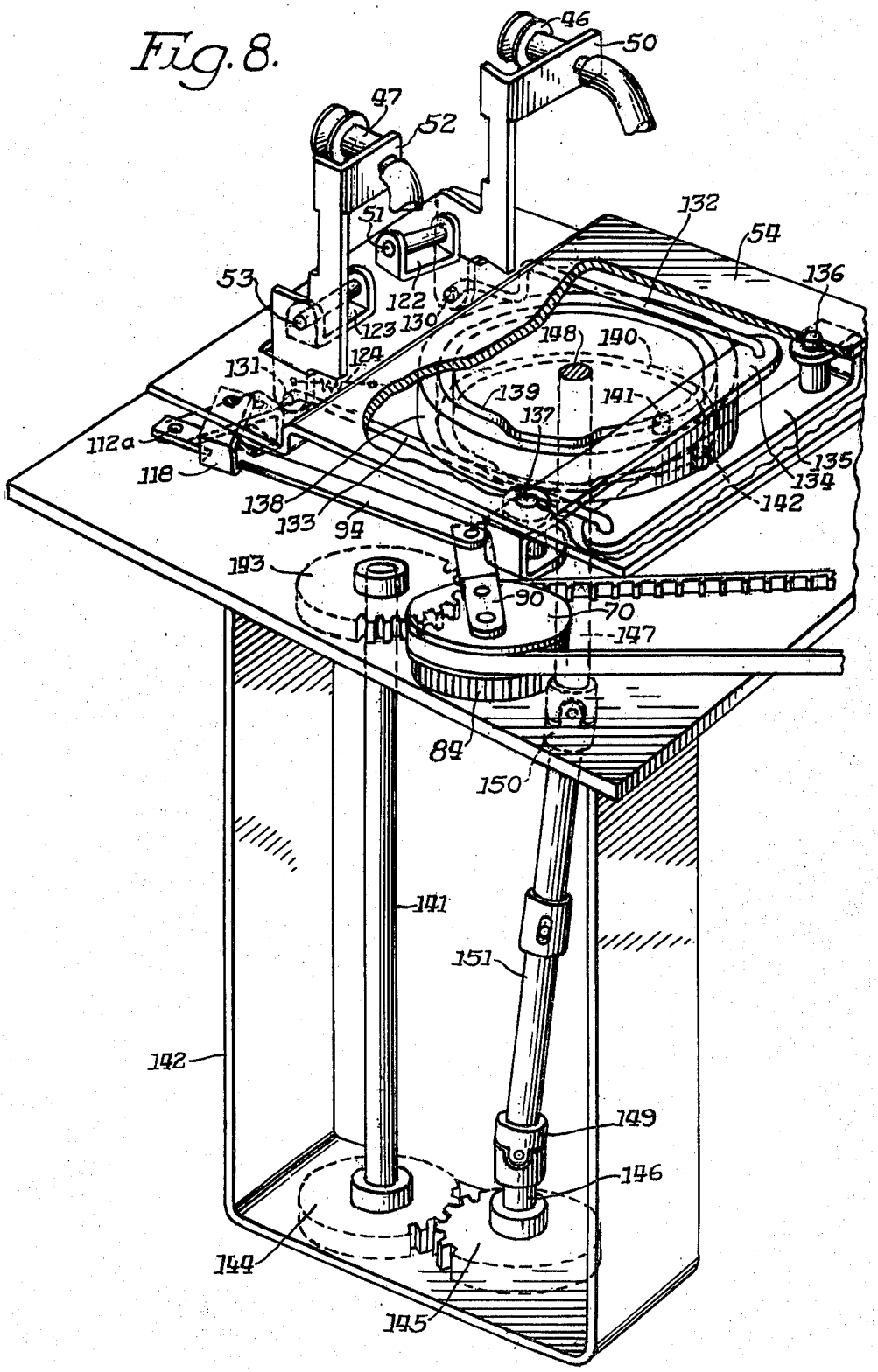
FIG. 8 is a perspective view with portions removed of a table mounted on the four-bar system, the drive system, the cam follower system and vacuum cups.

The movement of the pivot arms 50, 52 is controlled by a cam and linkage arrangement which can best be seen in FIG. 8. Beneath the table 54, the lower ends of the arms 50, 52 have link receiving holes 130, 131 which rotatively receive suitable connecting means such as links 132, 133. The opposite ends of the links 132, 133 are rotatively received at one end of second links 134, 135. The ends of links 134, 135 opposite the connections to links 132, 133 are U-shaped and pivotally connected by pins 136, 137 to the underside of the table 54. Thus, two four bar mechanisms are formed; the first is arm 50, link 132, link 134, ground; the second is arm 52, link 133, link 135, ground.

Control of the movement of these 2 four bar mechanisms is accomplished by means of a cam 138 having a captive top cam profile 138 and a captive bottom cam profile 140. Mounted on the link 134 is a follower pin 141 which follows top cam profile 139. Link 135 has a similar follower pin 142 which follows bottom cam profile 140. It can be seen that rotation of the cam 138 will cause the controlled movement of the 2 four-bar mechanism. This results in the controlled pivoting of the arms 50, 52 and movement of the vacuum cups 46, 47.

Power is applied to the cam 138 and the lower drive gear 84 via the power train illustrated in FIG. 8. An electric motor (not illustrated) is coupled to an end of an output shaft 141 mounted on a lower platform 142. A pinion 143 is mounted at an end of the shaft 141 to mesh with and drive the lower drive gear 84 which in turn causes pulley 70 to rotate. This provides power to the pulley 74 and the four bar mechanisms which move the table 54. A second pinion 144 provides power to gear 145 mounted to shaft 146. Cam 138 is affixed on a cam shaft 147 which has an end 148 rotatively fastened to the table 54. As the table 54 moves with respect to the lower platform 142, a flexible power connection means must be provided between the cam shaft 147 and the gear 145. This is provided by two universal drives 149, 150 connected by a slip shaft 151 having a variable length. Thus, as the table 54 moves through a cycle, the length of slip shaft 151 will vary so as to continuously provide power to the cam 138. The movement of the table 54 & rotation of the cam 138 is synchronized through the gears & pulleys so that the arms pivot and move a document at appropriate table positions.

The cyclic operation of the four-bar linkage and the somewhat crescent-shaped coupler curve of table 54 should be apparent from a study of FIGS. 9 & 10. FIG. 9 shows the articulation of one pair 92, 96, 100 ground, of the four-bar linkage, while the drive pulley makes one complete 360° rotation. The other four-bar linkage 90, 94, 98, ground, has the same articulation, always moving parallel, with the bars shown in FIG. 9. A line through the table-bearing point 114 (FIG. 6) on linkage bars 90, 94, 98, ground, and point 116 on linkage bars 92, 96, 100 ground, is always parallel to lines through the two pairs of ground points 102, 106 and 104, 108. Therefore, the table 54 and the edges of vacuum cups 46, 47 are also parallel to lines through these ground points and the envelopes of stack 38.

The two bearing points 114, 116 follow a somewhat crescent-shaped coupler curve which is seen as a series of "X" marks in FIG. 10. The driven timing pulley 74 is seen in the upper left-hand area of FIG. 10, with every 15° of a full 360° of rotation marked. The table-bearing point 116 is seen in the lower right-hand portion of FIG. 10. As the timing pulley 74 rotates through 0°–30°, the bearing point 116 is pushed forward toward the stack 38 (FIG. 1) of the envelopes. At 30° the bearing point 116 reaches its forward-most position, or cusp, where the vacuum cups pick up the forward-most envelope of the stack.

When the timing pulley 74 moves through the arc (30°–45°), the vacuum cups move away from the stack, in a direction almost perpendicular to the stack 38.

During the next leg of the excursion, 45°–210°, the table 54, carrying vacuum cups 46, 47, gradually changes direction, from initially substantially perpendicular to the stack 38 to substantially parallel to the stack 38 at 180°, and transports the document directly into the nip of the rollers 55, 56.

In the leg of the excursion from 210° to about 270° the table 54 carrying vacuum cups 46, 47, is backing away from the document, which is then being whisked through the nip rollers 55, 56, and at the same time is returning towards home (0°) position.

Thus, the vacuum cups are too far removed from the document to impact it in the manner suggested by location 46*a* (FIG. 2). Accordingly, the document is positively placed in the nip of rollers 55, 56 and does not rely on gravity to transport the document into the transport section.

During the leg of the excursion between 270° and 360°, the table 54 carries the vacuum cups 46, 47, back to the starting point, from which they move on to pick up the next document. The important thing to note is that, in the excursion leg from about 210° to about 270°, the vacuum cups are actually backing away from the document which is then in the nip of rollers 55, 56.

Figure 11:
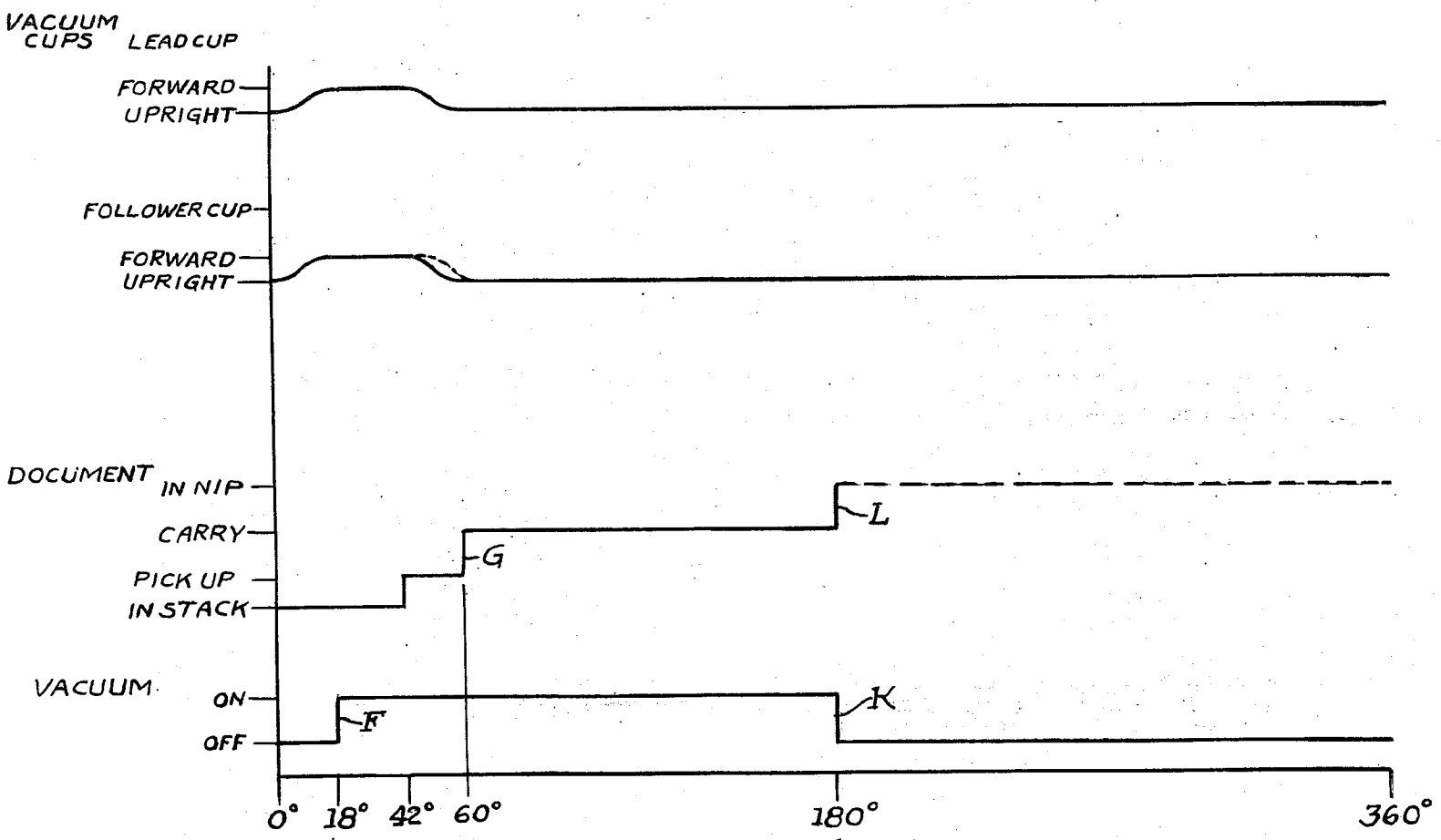
FIG. 11 is a timing diagram which explains the control sequence of the various systems in the inventive structure.
Figures 19A, 19B, 19C:
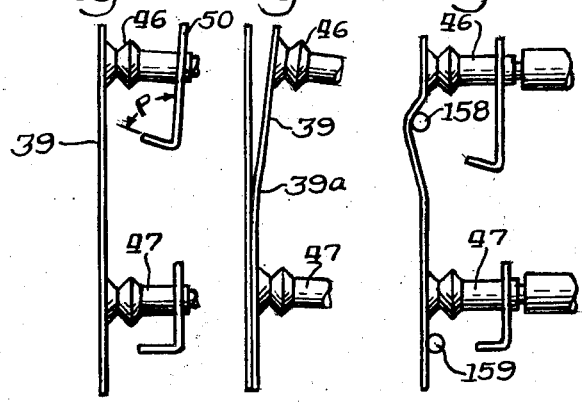
FIGS. 19*a*–19*c* are plan views schematically illustrating the separation and removal of a document at three time frames.
Figure 20:
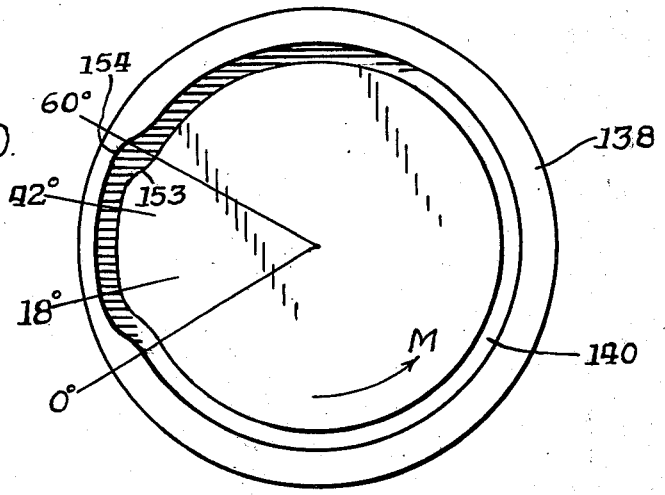
FIG. 20 is a top view of the cam track and profile which controls the pivoting of the follower vacuum cup.
Figure 21:
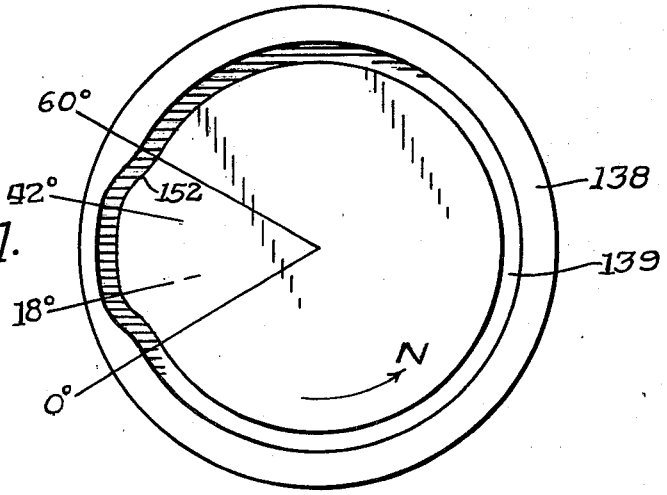
FIG. 21 is a top view of the cam track and profile which controls the pivoting of the lead vacuum cup.

FIGS. 11, 20 and 21 show how the cam 138 controls the document pickup and vacuum cycles. Cam 138 rotates in the direction of arrows M and N in FIGS. 20, 21. More particularly cam profiles 139 and 140, which are identical during the first 42° of the cycle, cause the arms 50, 52 to pivot from their upright to their forward-most positions at 18° rotation of the timing pulleys 70, 74. At the same time (point F, FIG. 11) a vacuum is applied to the cups 46, 47 due to cam 86 engaging switch 88 which initiates the vacuum. Thus, at 18° the lead cup 46 and the follower cup 47 have engaged and sealed against the surface of the document 39 as seen in FIG. 19*a*. The next 36° of the cycle is a dwell portion of the cam and the arms 50, 52 remain pivoted in their forwardmost positions.

The variance in the cam profiles 139, 140 occurs after the first 42° which is the portion of the cam profile which causes the arms 50, 52 to pivot to their upright positions. It can be seen in FIG. 20 that bottom cam profile 140 has two possible cam surfaces 153, 154 which pin 142 can follow. Top cam profile 139 can only follow surface 152 which is identical to surface 153. Which surface 153 or 154 the pin 142 will follow, depends on the document 39 thickness and the spring 124 connected to pivot arm 52.

In the case of a relatively thin document 39 having little rigidity or body, pin 142 will follow surface 154. The reason is that pin 141, which controls lead cup 46, will follow surface 152 pivoting lead cup 46 towards its upright position as shown in FIG. 19*b*. The spring 124 has sufficient force to overcome the body strength of the document 39 causing it to bend at 39*a*, which causes the pin 142 to follow cam surface 154. Thus, arm 52 stays forward and vacuum cup 47 stays in the position shown in FIG. 19*b*. This causes the cup 46 to peel the edge of document 39 from the adjacent document, and allows air to get between document 39 and the adjacent documents in the stack 38 reducing inter-document forces and improving document separation. This also decreased the possibility of having more than one document at a time pulled from the stack 38.

In the case of a thick document, which cannot easily be bent as shown by 39*a*, pin 142 will follow surface 153. This is due to the document body having sufficient strength to not bend causing it to overcome the force of spring 124. Thus, pin 142 will follow surface 153 and the entire document is pulled forward. Surfaces 153 and 152 are identical so arm 52 with follower cup 47 will assume an upright position simultaneously with arm 50 and lead cup 46.

FIG. 11 illustrates the timing relationship between the vacuum applied to the vacuum cups, the position of the envelope and the position of the vacuum cups. At 18° the lead cup 46 and follower cup 47 have both pivoted from their upright to forward positions and engage the document or envelope. The vacuum is applied to the cups as illustrated at point F. The lead cup begins pivoting to its upright position at about 42° and assumes its full upright position at 60°. The follower cup pivots to its upright position at either 42° or at 54° depending on the cam surface it is following. In either case, the follower cup reaches its full upright position at 60°. The document is then carried to the nip until 180° of the cycle has lapsed, when the document is placed in the nip as shown at point L. The vacuum is turned off at point K an instant before the document is picked up in the nip to reduce abrasion of the cups. The envelope stack is intentionally inclined to a nominal angle as in FIG. 14. This prevents the envelope from falling forward and, considering the teeth on the belt 42, 44 which prevents the bottom from sliding forward, makes loading more convenient. There are additional ridges 152 placed on frame 160 to further reduce the inter-document forces. This occurs because the document will tend to fall into the ridge 152 and tends to stand more upright thereby reducing the tendency of the documents to stick together.

Figure 13:
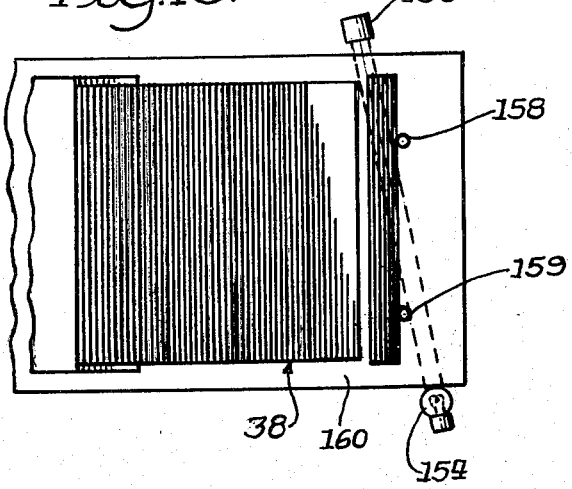
FIG. 13 schematically illustrates a photo cell used to activate a belt drive system to move the stack forward.
Figure 15:
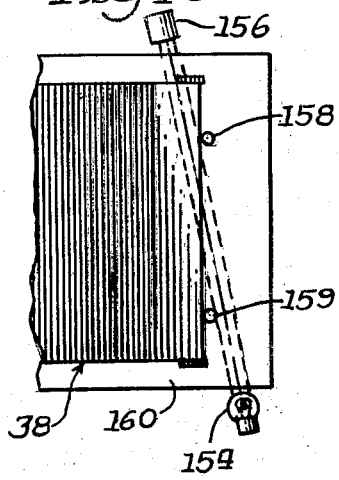
FIG. 15 schematically illustrates the system of FIG. 13 in the "off" position.
Figure 14:
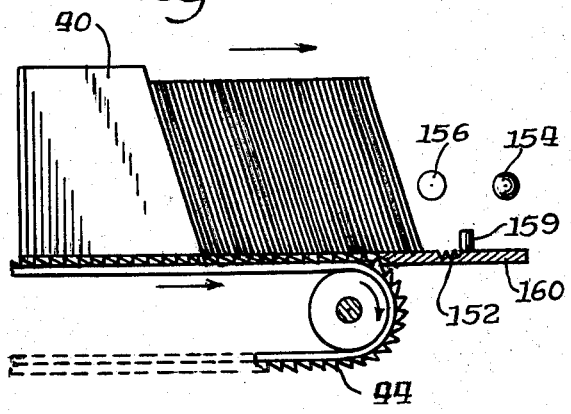
FIG. 14 is a side view of the schematic of FIG. 13.
Figure 16:
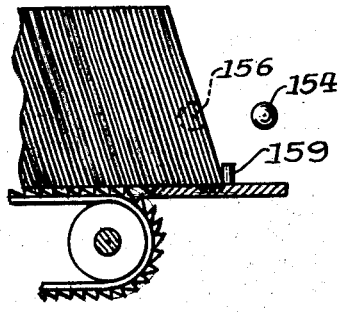
FIG. 16 is a side view of the schematic of FIG. 15.
Figure 17:
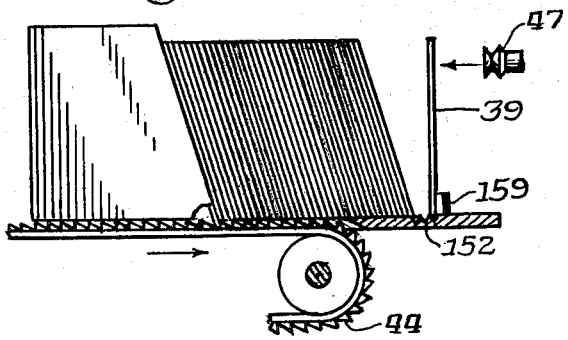
FIG. 17 schematically illustrates the stack feed belt moving the documents towards the vacuum cups and separating the documents for easy removal.
Figure 18:
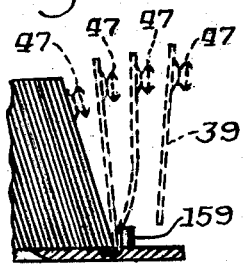
FIG. 18 schematically illustrates the removal of a document at four time frames.

The movement of the belts 42, 44 is controlled by a non-contact sensor such as a lamp 154 and photocell 156 (FIG. 13). The stack 38 is moved forward via the belts 42, 44 which are driven by a motor (not illustrated)

when envelopes are removed from the front of the stack. The photocell 156 detects the absence of envelopes, turning the motor on to drive belts 42, 44 forward as illustrated in FIGS. 13 and 14. Similarly, the motor is turned off when envelopes are present, such as illustrated in FIGS. 15 and 16. The front of the stack, thus, presents a substantially constant envelope surface to the vacuum cups.

As previously mentioned, the shaft 51 is placed at an angle of approximately 8° relative to the axis of shaft 53. So that vacuum cup 46 remains at all times perpendicular to the face of the document, the portion of arm 50 on which cup 46 is mounted, is at an angle P of approximately 82° which offsets the angle that shaft 53 is at. The lead vacuum cup 46 moves towards vacuum cup 47 when the arms 50, 52 are pivoted from their forwardmost to their upright positions. Similarly, when the arms 50, 52 are moving from their upright positions to their forwardmost positions, vacuum cup 46 moves away from vacuum cup 47. This creates approximately a ¼" buckle in the lead document 39 after it is engaged by the cups and drawn away from the stack 38. To help form the buckle, a pin 158 is affixed to the frame 160. Pin 158 and pin 159 also serve as stops for the documents as they are fed over the ridge 152. As the document 39 is pulled from the stack 38, the bottom edge of the document is snapped over the pins 158 and 159, while the next document is held back by the pins.

The advantage of the invention should now be apparent. The interdocument forces have been reduced to a minimum by peeling the lead document from the adjacent documents. Furthermore, the buckling of the documents allows air to enter between the lead document and adjacent documents thereby further reducing vacuum forces between documents Thus it is apparent that there has been provided, in accordance with the invention, an improved document feeder that fully satifies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A vacuum document feeder system comprising:

means for delivering documents from a stack to a document pick up location at one end of the stack, at least two documents seizing vacuum cups for engaging and removing a document from the one end of the stack, one of the cups being a leading vacuum cup which engages the document adjacent one edge of the document, and the other cup being a following vacuum cup spaced apart from the leading vacuum cup, the vacuum cups pivotally mounted on a support means to provide the vacuum cups with a pivoting motion toward and away from the one end of the stack, a first cam with a first cam surface and first follower means operatively connected to the leading vacuum cup to cause the leading vacuum cup to pivot toward and away from the one end of the stack at the same time during each cycle, a second cam and second follower means operatively connected to the following vacuum cup, the second follower capable of following either a second or third cam surface on the second cam, the second cam surface being identical to the first cam surface and causing the following vacuum cup to pivot away from the one end of the stack at the same time as the leading vacuum cup and the third cam surface permitting the second follower means to allow the following vacuum cup to remain pivoted toward the stack for a time delayed period with respect to the pivoting away from the stack of the leading vacuum cup, a drive means to provide power to the support means, cams and follower means to cause the support means and vacuum cups to cyclically move toward and away from the one end of the stack in substantially a perpendicular direction relative to the face of the document, the rigidity of the documents being withdrawn determining the cam surface on the second cam which the second follower will follow with the following vacuum cup pivoting away from the stack in unison with the leading vacuum cup when rigid documents are withdrawn and remaining pivoted toward the stack for the time delayed period when thin, flexible documents are withdrawn resulting in an edge of the document being peeled away from the next adjacent document in the stack when thin documents are withdrawn.

2. The vacuum document feeder system of claim 1 and further including spring means connecting the following vacuum cup to the support means, the spring means normally biasing the following vacuum cup to pivot towards the stack, whereby the rigidity of the document must be sufficient to cause the leading vacuum cup, when pivoted away from the stack, to overcome the force of the spring means permitting the second follower to follow the second cam surface which results in the following vacuum cup pivoting in unison with the leading vacuum cup.

3. The vacuum document feeder system of claim 2 wherein the second follower follows the third cam surface which results in the time delay for pivoting the following vacuum cup with respect to the leading vacuum cup when the rigidity of the document is insufficient to overcome the force of the spring means which is applied to the following vacuum cup biasing it towards the stack.

4. The vacuum document feeder system of claim 1 wherein the support means separate the vacuum cups by a first distance when engaging the document at the one end of the stack and by a second distance, which is less than the first distance, after seizing the documents, the movement of the vacuum means between the first and second distances after seizing the document causing the document to buckle which results in improved separation between the document at the one end of the stack and the adjacent document.

5. The vacuum document feeder of claim 4, wherein the documents are vertically positioned on an edge to form a horizontal stack from which the feeder removes documents from the one end.

6. The vacuum document feeder of claim 5 and further comprising means for applying a vacuum to the vacuum cup means when the vacuum cup means have pivoted toward and reached the stack, and for removing the vacuum when the vacuum cup means have pivoted away from the stack and removed the document.

7. The vacuum document feeder of claim 6 wherein the drive means causes the support means to move the vacuum cups from the document pick-up location to a document transport means for further processing of the document and removing the vacuum from the vacuum cup means when the document is placed in the transport means.

8. The vacuum document feeder of claim 7 wherein the documents are envelopes and the further processing is an automatic mail weighing machine.

9. The vacuum document feeder of claim 6 and further comprising feeder means to move the stack in a direction toward the vacuum cup means whereby the end document in the stack maintains a substantially constant plane.

10. The vacuum document feeder of claim 9 and further comprising retainer means at the document pick-up location to keep the documents from falling foward out of the stack until the vacuum cup means seizes the document and draws it past the retainer means.

* * * * *